United States Patent [19]

Wisseroth

[11] Patent Number: 4,601,251

[45] Date of Patent: Jul. 22, 1986

[54] ARRANGEMENT FOR ORIENTING ROCKETS MOVING IN LIQUIDS

[75] Inventor: Karl Wisseroth, Ludwigshafen, Fed. Rep. of Germany

[73] Assignee: BASF Aktiengesellschaft, Fed. Rep. of Germany

[21] Appl. No.: 391,853

[22] Filed: Jun. 24, 1982

[30] Foreign Application Priority Data

Jun. 26, 1981 [DE] Fed. Rep. of Germany ..... 3125108

[51] Int. Cl.[4] ..... F42B 19/01; F41F 3/00; E21B 29/02; E21C 37/00

[52] U.S. Cl. ..... 114/23; 166/299; 299/13; 89/1.809

[58] Field of Search ..... 114/23, 20 R, 21 R; 89/1.809, 1.810, 1.819; 166/299; 299/11, 13, 18

[56] References Cited

U.S. PATENT DOCUMENTS

| | | | |
|---|---|---|---|
| 333,008 | 10/1885 | Griswold | 114/23 X |
| 1,228,364 | 5/1917 | Macy | 114/23 |
| 1,378,740 | 5/1921 | Walkup | 114/23 |
| 1,410,872 | 5/1922 | Baldwin | 114/20 R |
| 2,338,322 | 2/1942 | Ferrer | 114/20 R |
| 2,363,363 | 11/1944 | Rubissow | 114/20 |
| 2,493,788 | 1/1950 | Turlay | 114/20 R |
| 2,596,120 | 5/1952 | Boyle | 114/20 R |
| 2,937,824 | 5/1960 | Krumbholz et al. | 114/20 R X |
| 3,060,854 | 10/1962 | Maretti | 114/20 R X |
| 3,134,353 | 5/1964 | Pederson et al. | 114/20 R |
| 4,451,088 | 5/1984 | Wisseroth | 166/299 X |

FOREIGN PATENT DOCUMENTS 581367 11/1924 France .

OTHER PUBLICATIONS

U.S. Navy Hydrographic Office, *Air Navigation,* 1955, Chapter IV, pp. 63–72, FIGS. 407–411, Chapter XXV, pp. 569–579.

*Primary Examiner*—Charles T. Jordan
*Assistant Examiner*—Brian Scott Steinberger
*Attorney, Agent, or Firm*—Keil & Weinkauf

[57] ABSTRACT

The horizontal orientation of a rocket moving in a liquid is achieved by an arrangement in which a magnet is attached to the rocket body. The axis of the rocket and the magnetic axis of the magnet form an azimuthal angle $\alpha$, which determines the direction of the rocket relative to the geomagnetic meridian.

2 Claims, 3 Drawing Figures

ARRANGEMENT FOR ORIENTING ROCKETS MOVING IN LIQUIDS

The present invention relates to an arrangement for achieving horizontal orientation of a rocket moving in a liquid.

Rockets which are operated in liquids, e.g. water, are used, for example, for transporting explosives to solid materials to be comminuted, an example being the explosive fragmentation of coal in a liquid-filled seam in the course of being mined. For this purpose, the rocket carrying the explosive passes to the seam through a borehole from the surface. After reaching the seam level, the rocket is in general automatically orientated, as a result of adjusting its center of gravity, at the intended angle of elevation, which predominantly corresponds to the horizontal or to directions deviating only slightly therefrom. In contrast, the azimuthal angle remains undetermined, so that after the propellant charge has been ignited the rocket will move in an arbitrary horizontal direction. However, it is usually desirable to mine the coal in a very particular direction, for example one determined by the geological conditions.

It is an object of the present invention to provide an arrangement by means of which the direction of motion of a rocket moving in a liquid can also be adjusted in respect of its azimuthal orientation.

I have found that this object is achieved when a magnet is attached to the rocket body, and the axis of the rocket and the magnetic axis of the magnet form an azimuthal angle $\alpha$, which determines the direction of the rocket relative to the geomagnetic meridian.

Further details and advantages of the novel arrangement are to be found in the Example described below with reference to the drawing.

Figure 2:
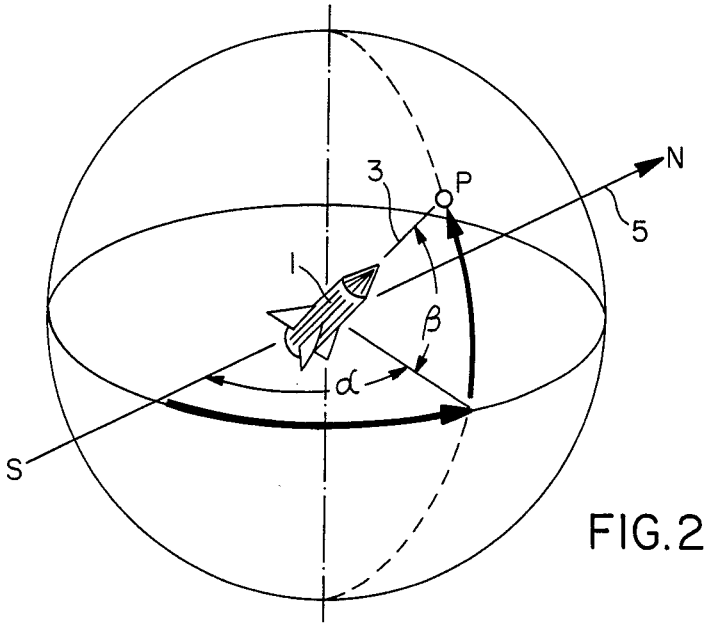
FIG. 2 shows a spherical representation of the orientation
Figure 1:
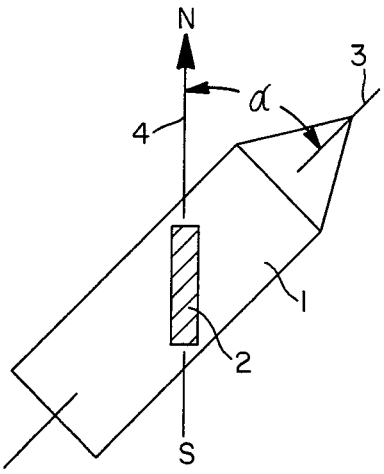
FIG. 1 shows a schematic representation of a rocket body with a bar magnet

The novel arrangement for achieving horizontal azimuthal orientation is shown schematically in FIG. 1. The arrangement comprises the rocket body 1 to be moved and a bar magnet 2 which is attached to 1 either externally or internally, by screws or pins, or other suitable means of attachment, so that the rocket axis 3 and the axis 4 of the bar magnet 2 form an azimuthal angle $\alpha$, which determines the direction of the rocket relative to the geomagnetic meridian 5 (FIG. 2).

The aligning force K is defined by the torque acting at the center of gravity of the rocket body, according to the mathematical relationship $$K \cdot a = H.M. \sin \alpha,$$

where a is the lever arm, H is the strength of the earth's magnetic field, M is the magnetic moment of the bar magnet 2, and $\alpha$ is the azimuthal angle.

The magnetic field of the earth is relatively weak. By suitable choice of the magnetic moment of the bar magnet it is, however, possible to attain the required directional force K. The applied force K serves to overcome the forces of inertia corresponding to the moment of inertia $$\Theta = \frac{K \cdot \ddot{\alpha}}{\alpha}$$

of the rocket to be orientated, where $\ddot{\alpha}$ is the angular acceleration, as well as to overcome the frictional forces which are in any case noticeable in a liquid. The available permanent magnets, such as barium ferrites and aluminum/nickel/cobalt alloy bar magnets, which possess remanence flux densities which are high enough readily to overcome both the forces of inertia and the frictional forces. In one respect, the frictional forces even prove useful, in that they assist the oscillation into the final position by strongly damping the rotary motion.

Figure 3:
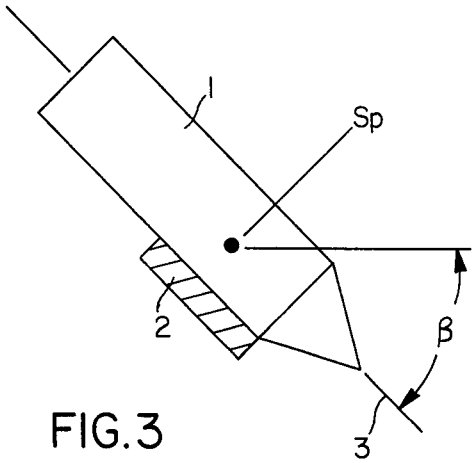
FIG. 3 shows a schematic representation of a shift in the center of gravity of the rocket body by means of the bar magnet.

The bar magnet 2 can be attached to the rocket as additional ballast, as illustrated, for example, in FIG. 3. By displacing the center of gravity Sp of the rocket, it is also possible simultaneously to adjust the angle of elevation $\beta$ of the rocket direction. By this combination of measures, virtually any point P on a sphere of reference around the center of gravity of the rocket may be reached (FIG. 2).

The Example which follows illustrates the mode of action of the novel arrangement.

EXAMPLE

A rocket of 20 cm length and 3.5 cm diameter carries a propellant charge of 25 g of pellet powder and, in addition, an auxiliary charge of 250 g of explosive. To stablize the course, a guide sleeve of 10 cm length and 5 cm diameter is pushed coaxially over the end of the rocket body so that the end of the sleeve projects 5 cm beyond the jet opening. A bar magnet having a weight of 50 g and a magnetic moment of $5.10^{-7}$ V.s.m is attached underneath the rocket and has its magnetic north/south axis at 45° to the rocket axis, so that, after orientation, the rocket points approximately northwest. Simultaneously with the attachment of the magnet, a compensation in respect of weight is also effected such that, first, the rocket axis is horizontal and, secondly, the rocket approximately achieves a floating state in the supporting liquid. The complete rocket arrangement is introduced in an arbitrary orientation into a concentrated $CaCl_2$ solution which has a density of 1.4 g/cm$^3$ and is under a pressure of 150 bar. After about 2 seconds, the rocket oscillates into the intended direction and points at the target. The propellant charge is then ignited by a pressure igniter with a 5 second delay. Thereafter, the rocket moves on a stable course to the target, where the explosive charge is ignited by a percussion detonator.

I claim:

1. An improved rocket device for carrying an explosive charge to a liquid filled coal seam including a body having an axis and containing a propellant charge and an explosive charge, said improvement comprising:
   - a permanent magnet secured to the said rocket body at an azimuthal angle to said rocket body axis
   - said magnet having a magnetic moment great than $5.10^{-7}$ volts second meter sufficient with respect to the weight of said rocket to orient the said rocket body at a corresponding angle to the north-south magnetic meridian when said body is suspended in said liquid, and said magnet being manually movable lengthwise of the rocket device so as to be positioned on said body in the direction of said axis to displace the center of gravity of the said rocket and magnet to adjust an angle of elevation of said rocket body axis in said liquid.

2. An arrangement as claimed in claim 1, wherein the magnet is a bar magnet.

* * * * *